US006077112A

United States Patent [19]

Daoud et al.

[11] Patent Number: 6,077,112

[45] Date of Patent: Jun. 20, 2000

[54] CONNECTOR WITH IMPROVED DIELECTRIC STRENGTH

[75] Inventors: Bassel H. Daoud, Parsippany; George A. DeBalko, Long Valley; Christopher M. Helmstetter, Bridgewater; Jason A. Kay, Morristown; Walter Pelosi, Randolph, all of N.J.

[73] Assignee: Lucent Technologies Inc., Murray Hill, N.J.

[21] Appl. No.: 09/217,096

[22] Filed: Dec. 21, 1998

[51] Int. Cl.[7] ..... H01R 13/52

[52] U.S. Cl. ..... 439/521; 439/934; 439/206

[58] Field of Search ..... 439/409, 417, 439/934, 521, 695, 281, 206

[56] References Cited

U.S. PATENT DOCUMENTS

| | | | |
|---|---|---|---|
| 2,495,206 | 1/1950 | Brus | 439/695 |
| 3,611,264 | 10/1971 | Ellis | 439/403 |
| 4,090,759 | 5/1978 | Herrmann, Jr. | 439/281 |
| 4,214,802 | 7/1980 | Otani et al. | 439/281 |
| 4,437,719 | 3/1984 | Miyamoto | 439/521 |
| 4,662,699 | 5/1987 | Vachhani et al. | 439/395 |
| 4,793,823 | 12/1988 | Cozzens et al. | 439/409 |
| 4,857,017 | 8/1989 | Erk | 439/695 |
| 5,215,475 | 6/1993 | Stevens | 439/206 |
| 5,240,432 | 8/1993 | Daoud | 439/417 |
| 5,637,011 | 6/1997 | Meyerhoefer et al. | 439/409 |
| 5,860,829 | 1/1999 | Hower et al. | 439/417 |

FOREIGN PATENT DOCUMENTS

| | | | |
|---|---|---|---|
| 890377 | 2/1962 | United Kingdom | 439/281 |

OTHER PUBLICATIONS

Technical Data Sheet of A.C. Egerton Limited, related to Mini Rocker Cross Connection Cabinets.

*Primary Examiner*—Paula Bradley
*Assistant Examiner*—Tho D. Ta
*Attorney, Agent, or Firm*—Stroock & Stroock & Lavan LLP

[57] ABSTRACT

A connector having improved dielectric strength is provided and includes a lower portion having a front side and a rear side and a bottom, a pair of terminal disposed in the lower portion, each of the pair of terminals having a side extension and a wire wrap tail, one of the pair of terminals being disposed in the lower portion toward the front side, the other of the pair of terminals being disposed in said lower portion toward the rear side thereby forming a gap between the side extensions of each of the pair of terminals. A base having a pair of terminal openings for receiving the pair of terminals, respectively, with the base being dimensioned and shaped for receiving the lower portion. A protruding wall is disposed in the base between the pair of terminal openings. A notch is disposed on the bottom of the lower portion, the notch being dimensioned and shaped so that when the lower portion is placed in the base, the protruding wall is matingly engaged with the notch.

14 Claims, 7 Drawing Sheets

CONNECTOR WITH IMPROVED DIELECTRIC STRENGTH

FIELD OF THE INVENTION

This invention relates to a connector and, in particular, to a connector having a improved dielectric strength.

BACKGROUND OF INVENTION

In a telephone network, a network cable from the central office is connected to a building entrance protector (BEP) located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, an SC 99 type connector block, such as are available from Lucent Technologies Inc., or a mini-rocker type connector such as those sold by A. C. Egerton, Ltd.

A mini-rocker type connector generally has a movable top section which comprises two wire insertion holes and a lower fixed section which houses a pair of terminals, each terminal having a terminal strip for receiving a wire. The top movable section pivots about a pivot point located towards back side of the connector. The top section has a movable latch member to maintain the top section in its closed position. To open the top section, a user releases latch member and pivots the top section around the pivot point to its open position.

When the top section is open, the terminal strips do not intersect the wire insertion holes, and when the top section is closed, the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are brought into electrical contact with the terminal strips. To remove the wires and/or break the electrical connection, the process is reversed.

Referring now to FIGS. 1–3, there is shown a prior art connector 10 having a movable top section 12, a fixed lower section 14, a living hinge 32 and a pair terminals 28*a*,28*b*. As seen in FIG. 2A, each of terminals 28*a*,28*b* includes one of a pair of wire-wrap tails 29*a*,29*b* and one of a pair of side extensions 30*a*,30*b* that are used to seat terminals 28*a*,28*b*, respectively, in connector 10 and to prevent terminals 28*a*, 28*b* from rocking sideways. Because each of terminal pairs 28*a*,28*b*, must be electrically isolated from the other, it is necessary to position terminal 28*a* toward one portion of lower section 14 and terminal 28*b* toward another portion of lower section 14, as shown in FIG. 3. This results in the formation of a gap G between side extension 30*a* of terminal 28*a* and side extension 30*b* of terminal 28*b*. The dielectric strength between terminals 28*a*,28*b* is directly proportional to the size of gap G. Therefore, if gap G is reduced, the dielectric strength between terminals 28*a*,28*b* is also reduced, with negative results.

In order to improve the dielectric strength between terminals 28*a*,28*b*, prior art connectors employed a base 34, as seen in FIG. 1, that is dimensioned and shaped for receiving lower section 14 of connector 10. Base 34 includes a pair of terminal openings 36*a*,36*b* separated by a wall 38 so that when connector 10 is inserted in base 34, terminals 28*a*,28*b* extend through terminal openings 36*a*,36*b*, respectively. Also, when connector 10 is inserted in base 34, a cavity C is formed by side extensions 30*a*,30*b*, wall 38, and the bottom of lower section 14. A gel, having a high dielectric constant, is placed in cavity C thereby insulating terminals 28*a*,28*b* thus improving the dielectric performance of connector 10. Such gels are known in the art and commonly used in connectors of the type described.

A drawback of using gel to improve dielectric performance is that it requires additional steps in the installation process of the connector. Also, if the gel is not properly inserted, sufficient dielectric strength may not be achieved and the connector may fail.

SUMMARY OF THE INVENTION

The present invention is directed at overcoming shortcomings in the prior art. In accordance with the present invention, a connector having improved dielectric strength is provided and includes a lower portion having a front side, a rear side and a bottom. A pair of terminals, each having a side extension and a wire wrap tail, is disposed in the lower portion. One of the pair of terminals is disposed toward the front side of the lower portion and the other of the pair of terminals is disposed toward the rear side of the lower portion thereby forming a gap between the side extensions. A base having a pair of terminal openings for receiving the wire-wrap tails is included, with the base being dimensioned and shaped for receiving the lower portion. A protruding wall is disposed in the base between the pair of terminal openings. A notch is disposed on the bottom of the lower portion adjacent the gap, the notch being dimensioned and shaped so that when the lower portion is placed in the base, the protruding wall is matingly engaged with the notch. Thus, when the lower portion is placed in the base, the protruding wall is interposed between the pair of terminals thereby increasing the dielectric strength between the pair of terminals. Additionally, the shape of the base below the protruding wall is so formed as to improve the dielectric between the wire wrap tails as well.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DESCRIPTION OF A PREFERRED EMBODIMENT

Figure 1:
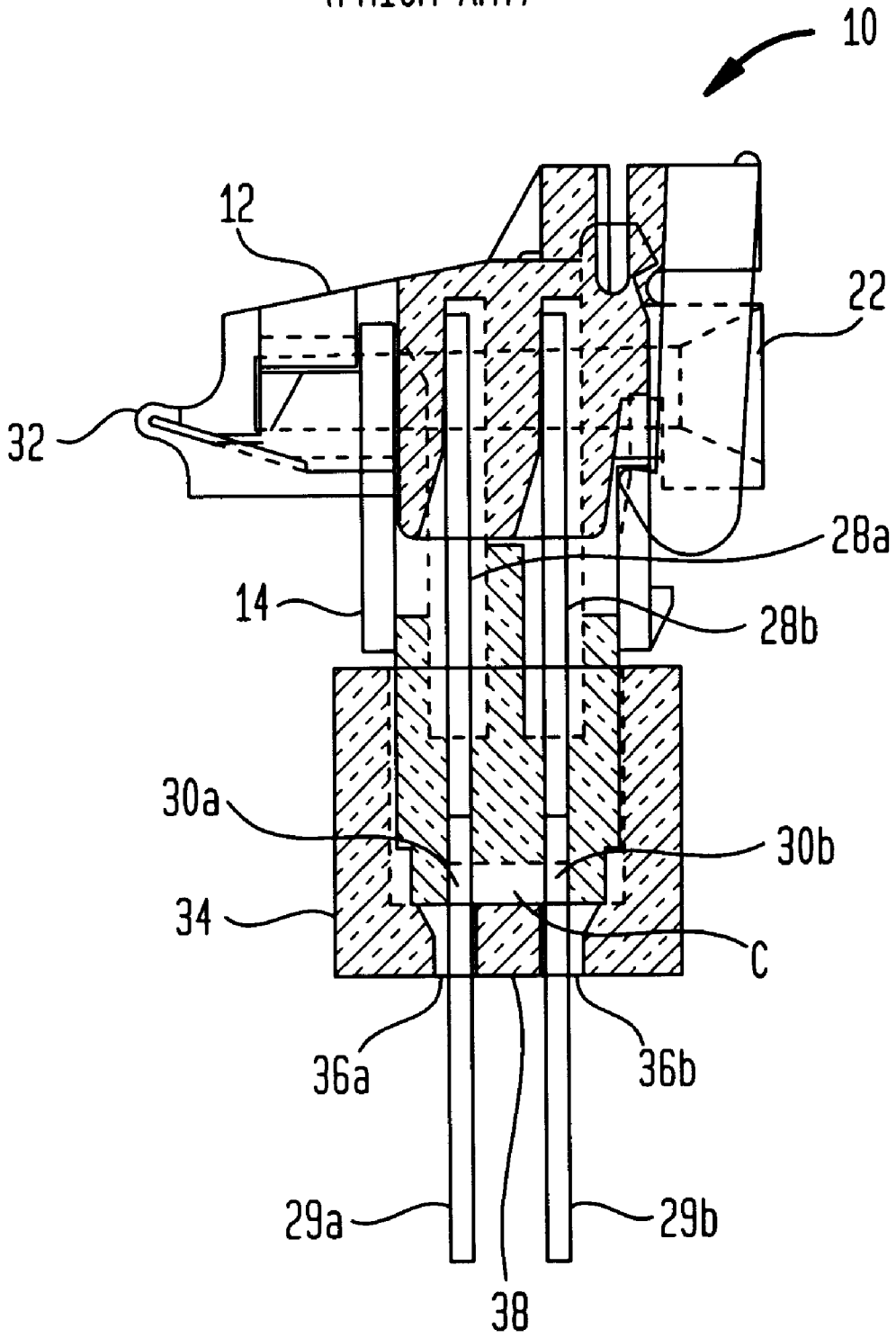
FIG. 1 (PRIOR ART)
FIG. 1 is a side view of a prior art connector and base.
Figure 2:
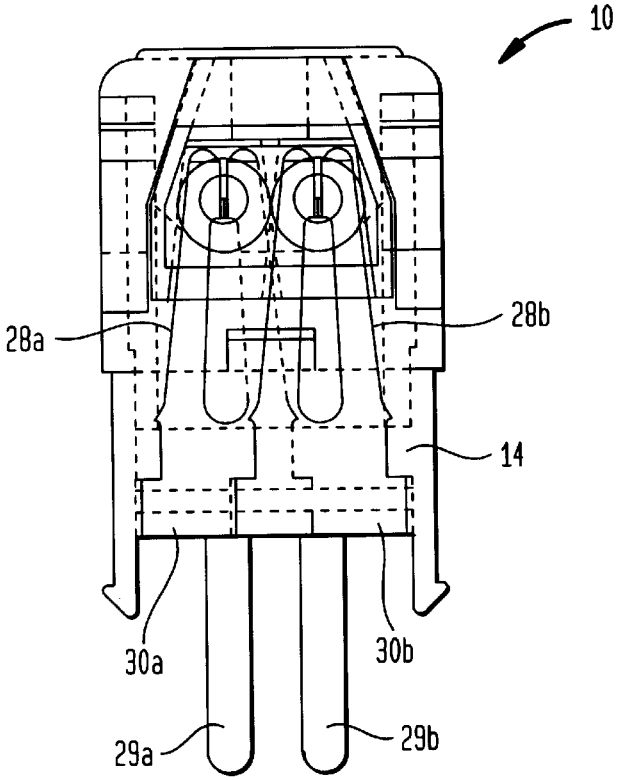
FIG. 2 (PRIOR ART)
FIG. 2 is a front view of the prior art connector of FIG. 1.
Figure 2A:
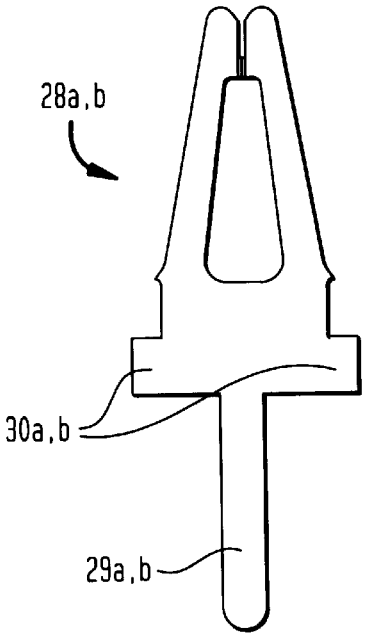
FIG. 2A (PRIOR ART)
FIG. 2A is a front view of a terminal strip used in the prior art connector of FIG. 1.
Figure 3:
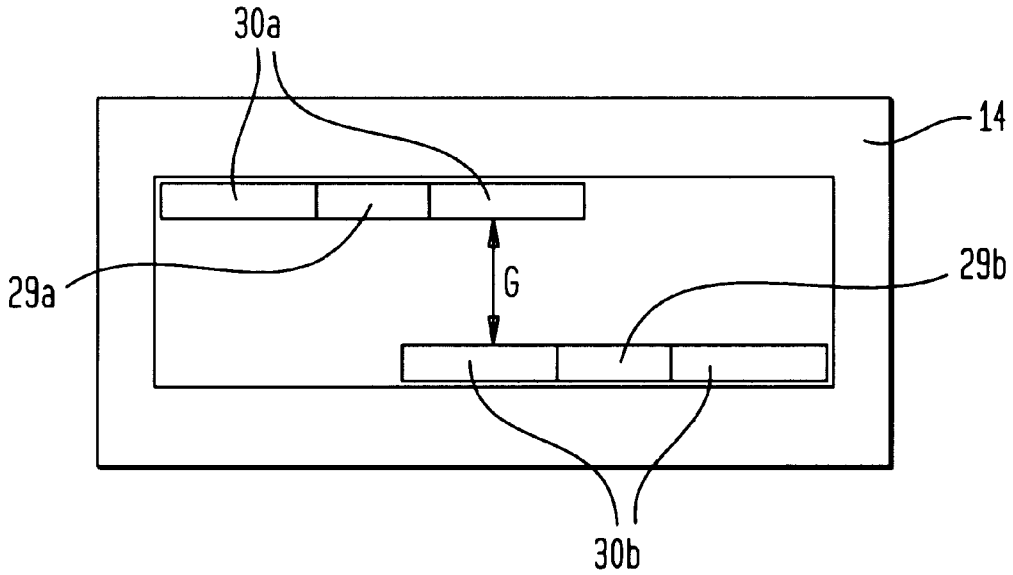
FIG. 3 (PRIOR ART)
FIG. 3 is a bottom view of the prior art connector of FIG. 2.
Figure 4:
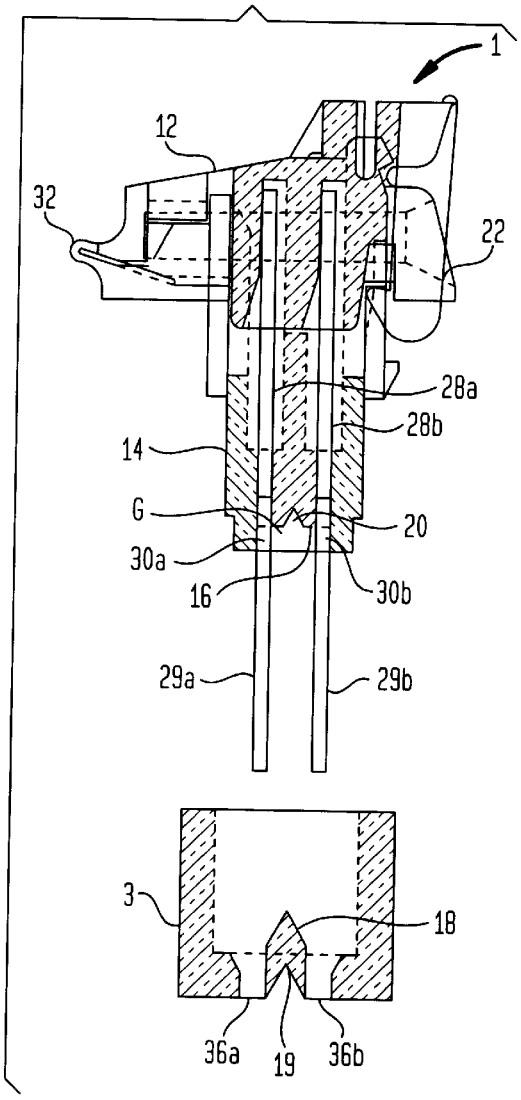
FIG. 4 is a side view of the connector and base according to a first embodiment of the present invention.
Figure 5:
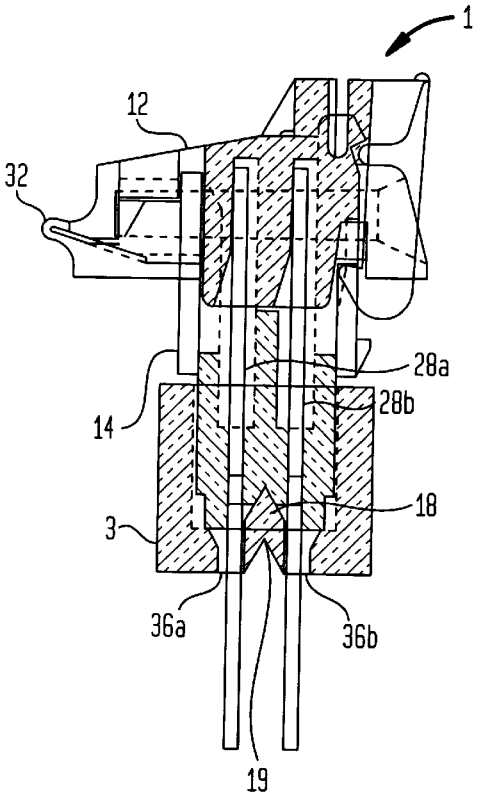
FIG. 5 is a side view of the connector of FIG. 4 inserted into the base of FIG. 4.
Figure 6:
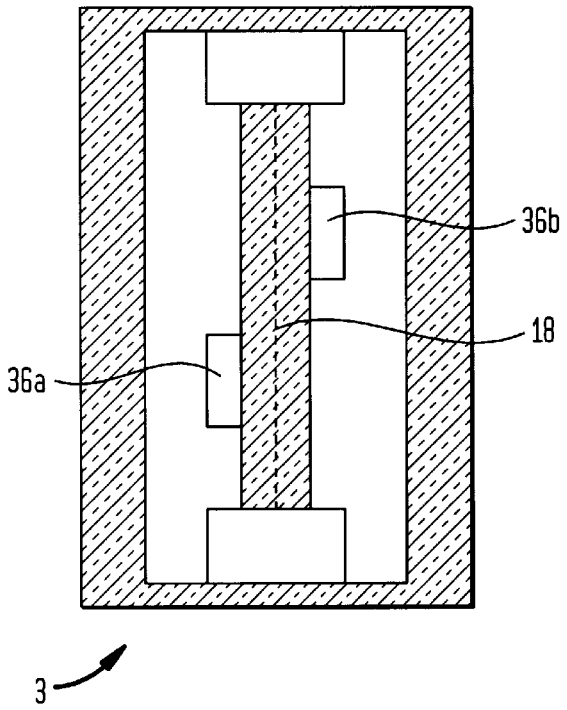
FIG. 6 is a top view of the base of FIG. 4 without the connector inserted.

Referring now to FIGS. 4–7, there is shown a connector 1 and base 3 made in accordance with a first embodiment present invention. Connector 1 of the present invention includes a top section 12 having two wire insertion holes 22, a lower fixed section 14 having a bottom 16 and a pair of terminals 28*a*,28*b* housed therein. A living hinge 32 connects the top section 12 and the lower fixed section 14. Each of terminals 28*a*,28*b* has one of a pair of wire-wrap tails 29*a*,29*b* and one of a pair of side extensions 30*a*,30*b*, respectively. A gap G is formed between side extension 30*a* of terminal 28*a* and side extension 30*b* of terminal 28*b*. Base 3 includes a pair of terminal openings 36*a*,36*b*. Base 3 is dimensioned and shaped so that when connector 1 is inserted in base 3, connector 1 is seated within base 3 and terminals 28*a*,28*b* extend through terminal openings 36*a*,36*b*, respectively (FIG. 5). Terminal openings 36*a*,36*b* are separated by a protruding wall 18 that runs along the entire width of base 3 as shown in FIG. 6. Protruding wall 18, like the rest of base 3, is preferably formed from material having good insulating properties so as to form a dielectric between the terminals, as discussed below.

Figure 7:
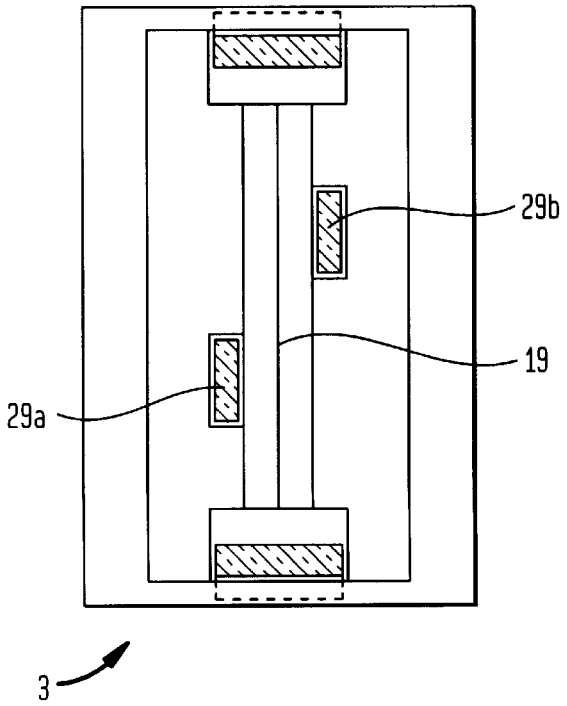
FIG. 7 is a bottom view of the base of FIG. 4 with the connector inserted.
Figure 7A:
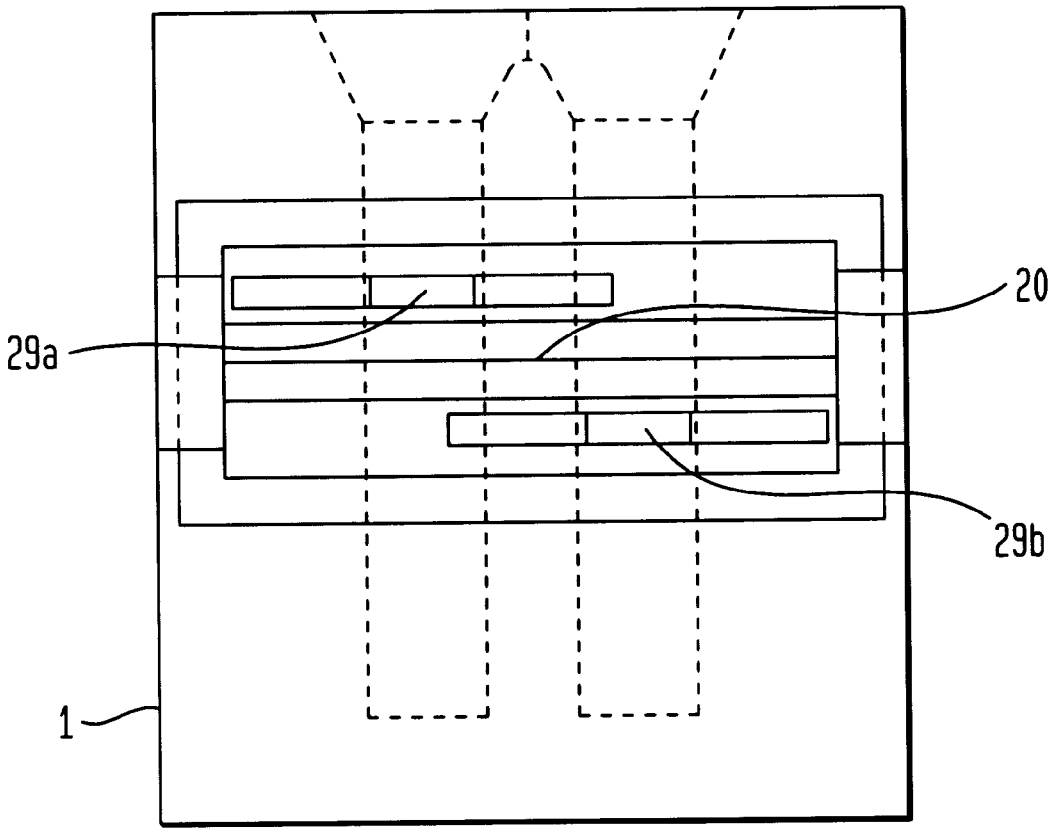
FIG. 7A is a bottom cross-sectional view of the connector of FIG. 4.

Disposed on bottom 16 of lower fixed section 14 of connector 1, in a position that is adjacent gap G, is a notch 20 that runs along substantially the entire width of lower fixed section 14, as shown in FIG. 7A. Protruding wall 18 and notch 20 are dimensioned and shaped so that when connector 1 is inserted into base 3, protruding wall 18 is matingly engaged with notch 20. When protruding wall 18 is matingly engaged with notch 20, protruding wall 18 forms an insulating barrier between side extension 30*a* of terminal 28*a* and terminal 28*b*. Because protruding wall 18 is electrically insulates side extension 30*a* from side extension 30*b*, protruding wall 18 increases the dielectric strength between terminals 28*a*,28*b*, and reduces the risk of short circuits, without the use of gel. Thus, the manufacturing and installation inefficiencies associated with the use of gel are eliminated while at the same time increasing the dielectric strength of connector 1.

Notch 20 and protruding wall 18 may be of any size and shape as long as protruding wall 18 can matingly engage with notch 20 within gap G. In the first embodiment of the present invention, both notch 20 and protruding wall 18 are v-shaped, as shown in FIGS. 4–5.

To further increase the dielectric strength of terminals 28*a*,28*b*, connector 1 and base 3 of the present invention also aid in the prevention of a breakdown in the dielectric between the terminals as a result of condensation build-up between terminals 28*a* and 28*b*, thereby reducing the likelihood of an electrical short between terminals 28*a* and 28*b*. Referring to FIGS. 4–5, it can be seen that notch 20 increases the surface area along bottom 16 of lower portion 14 between terminals 28*a* and 28*b*. Because moisture tends to accumulate on bottom 16, increasing the surface area of bottom would increase the amount of moisture needed to cause an electrical short between terminals 28*a* and 28*b*. Thus, the addition of notch 20 of lower portion 14 will reduce the possibility that moisture buildup will cause an electrical short.

A widthwise extending groove or notch 19 disposed on the bottom outer surface of base 3 in between terminal openings 36*a* and 36*b* similarly serves to reduce the likelihood of connector failure due to condensation, as shown in FIGS. 4–5 and 7. When connector 1 is inserted into base 3, notch 19 of base increases the surface area of the bottom of base 3 between wire-wrap tails 29*a* and 29*b*. As a result, it less likely that moisture buildup between wire-wrap tails 29*a* to 29*b* would result in an electrical short. Notch 19 may be any size or shape that increases the surface area of the bottom outer surface of the base such that condensation, or the effects thereof, are minimized or eliminated. Thus, it may or may not extend across the entire width of the base, and may extend inward, or project outward, as a matter of design choice.

Figure 8:
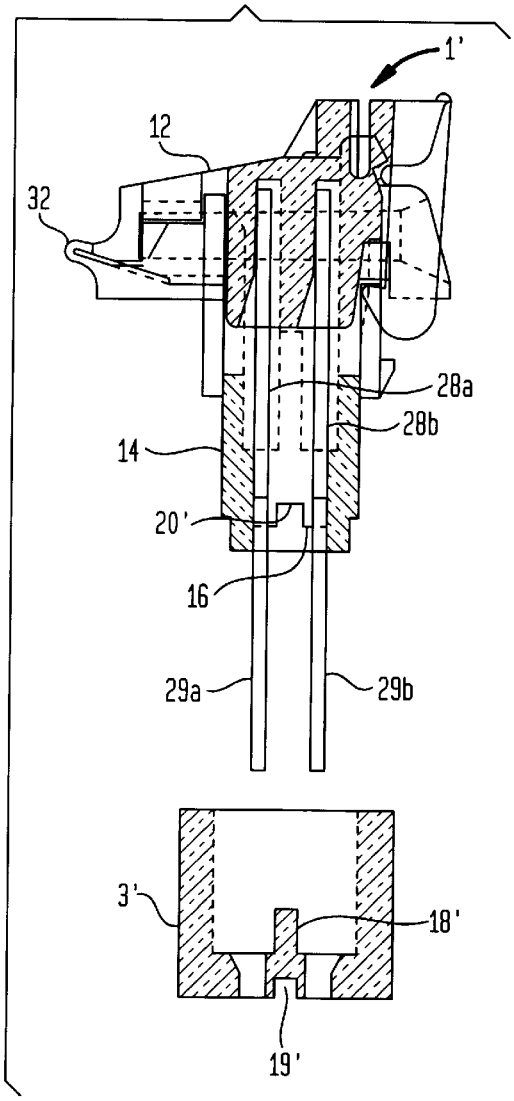
FIG. 8 is a side view of the connector and base according to a second embodiment of the present invention.
Figure 9:
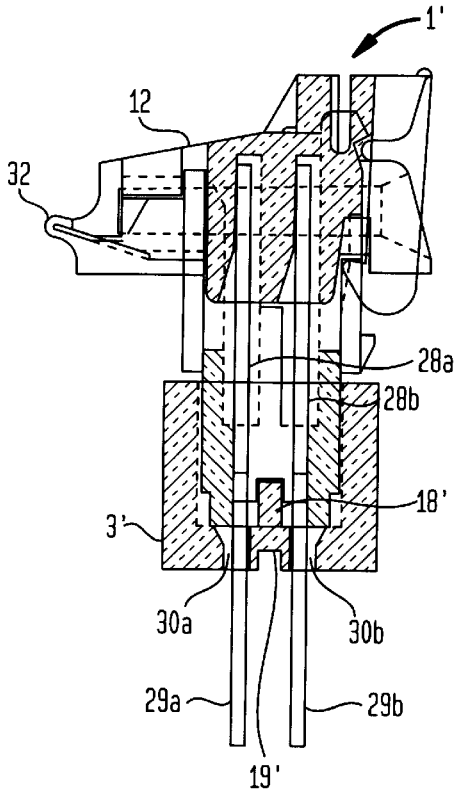
FIG. 9 is a side view of the connector of FIG. 8 inserted into the base of FIG. 8.

Referring now to FIGS. 8–9, there is shown a connector 1' and a base 3' according to a second embodiment of the present invention. Elements that are similar to elements included in the first embodiment are similarly labeled and a detailed description thereof will be omitted.

According to the second embodiment of the present invention, connector 1' includes a notch 20' and base 3' includes a protruding wall 18' and a notch 19', respectively, that are rectangularly shaped.

Like protruding wall 18 of connector 1 of the first embodiment, protruding wall 18' of connector 1' acts as a dielectric barrier between side extensions 30*a* and 30*b* thereby increasing the dielectric strength of terminals 28*a* and 28*b*. Furthermore, because protruding wall 18' and notch 20' are rectangular, the surface area between terminals 28*a* and 28*b* across bottom 16 is increased over the first embodiment. Similarly, notch 19' disposed on the outer bottom surface of base 3' will increase the surface area between wire-wrap tails 29*a* and 29*b* across the bottom of base 3'. Thus, protruding wall 18' and notch 19' will further decrease the likelihood of connector failure due to moisture condensation.

In all embodiments, the exact shape and dimension of the protruding wall and the mating notch or groove into which it fits is a matter of choice, it being understood from the teachings herein that the purpose of these parts is to form a dielectric barrier between terminal strips. Thus the wall and notch or groove could be reversed with respect to respective mounting on either the base or the connector. Further, the mating shape could be simple abutment, such that two wall portions of differing or equal size are formed thereby, or one wall of sufficient size to fill the gap could be formed on either the connector or base to abut a flat or mating surface on the other.

Accordingly, the present invention provides a connector and base in which the dielectric strength between the terminals is increased and the likelihood of an electrical short being caused by condensation between the terminals is reduced.

In all embodiments, terminals 28*a*,28*b* may be formed of any commonly known conductive metal known in the art and suitable for use in such terminals, such as, for example, platinum washed phosphor bronze, or beryllium-copper alloy or other metal or alloy combining good electrical conductivity with sufficient mechanical strength and resilience. Similarly, connector 1 and base 3 are preferably formed of a molded synthetic resinous material with good insulating properties and mechanical strength. The specific materials utilized in constructing connector 1 and base 3 are an application specific matter of design choice within the knowledge of the person of skill familiar with terminal blocks utilized in the telephony art. Moreover, the specific means of affixing terminals 28*a*,28*b* within connector 1 may be of any of the numerous methods of affixation known in the art, such as snap fitting, adhesives, friction fitting, integral molding, and the like, depending on whether ready removal and re-insertion of the terminal is required, as a matter of application specific design choice.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A connector having improved dielectric strength, said connector comprising:

a lower portion with a front side, a rear side and a bottom;

a pair of terminals being disposed in said lower portion, each of said pair of terminals having a side extension and a wire wrap tail;

a first terminal of said pair of terminals disposed in said lower portion toward said front side;

a second terminal of said pair of terminals disposed in said lower portion toward said rear side thereby forming a gap between said side extension of said first of said pair of terminals and said side extension of said second of said pair of terminals, a base having a pair of terminal openings for receiving said wire-wrap tails, said base being dimensioned and shaped for receiving said lower portion;

a protruding wall disposed between said pair of terminal openings; and a notch disposed on said bottom of said lower portion adjacent said gap and facing said base, said notch partially bounding at least said first terminal and being dimensioned and shaped so that when said lower portion is placed in said base, said protruding wall is matingly engaged with said notch so as to form a dielectric barrier in said gap between said side extension of said terminals.

2. The connector of claim 1, wherein said notch and said protruding wall are matingly v-shaped.

3. The connector of claim 1, wherein said notch and said protruding wall are matingly rectangularly shaped.

4. The connector of claim 1, further comprising a second notch disposed on a bottom outer surface of said base between said terminal openings so that a surface area of said bottom outer surface between said terminal openings is increased and the likelihood of the formation of sufficient condensation to form an electrical connection between said terminal openings is decreased.

5. A connector having a reduced likelihood of electrically shorting, said connector having a lower portion with a front side, a rear side and a bottom, a pair of terminals being disposed in said lower portion, each of said pair of terminals having a side extension and a wire wrap tail, a first of said pair of terminals disposed in said lower portion toward said front side, a second of said pair of terminals disposed in said lower portion toward said rear side thereby forming a gap between said side extension of said first of said pair of terminals and said side extension of said second of said pair of terminals, the connector comprising:

a notch disposed on said bottom of said lower portion adjacent said gap so that the surface area of said bottom between said side extensions of each of said pair of terminals is increased, said notch partially bounding at least one of said terminals.

6. The connector of claim 5, wherein said notch is v-shaped.

7. The connector of claim 5, wherein said notch is rectangularly shaped.

8. A connector base for reducing the likelihood that a connector will electrically short, said base having a receiving portion being dimensioned and shaped for receiving said connector, said connector having a pair of terminal strip lower extremities extending therefrom, said base comprising:

a pair of terminal openings for receiving said extremities therethrough; and a notch disposed on a bottom outer surface of said base between said terminal openings so that the surface area of said bottom outer surface between said terminal openings is increased and the likelihood of the formation of sufficient condensation to form an electrical connection between said terminal openings is decreased.

9. The connector of claim 8, wherein said notch is v-shaped when viewed in side section.

10. The connector of claim 9, wherein said notch is substantially rectangularly shaped when viewed in side section.

11. A tool-less insulation displacement connector comprising:

first and second terminal strips, each terminal strip having an upper portion for electrical and mechanical connection to a conductor and a lower portion comprising a wire wrap tail;

an upper housing section formed of an insulating material, said upper housing section housing said terminals in spaced apart relation; and a lower base section formed of an insulating material and removeably matingly engageable with said upper housing section, said upper housing section and said lower base section being so sized and shaped that upon mating engagement of the two, a dielectric barrier is formed between the respective upper portions of said terminal strips that partially bounds at least said first terminal strip, said dielectric barrier being unitarily formed with said upper housing section and said lower base section.

12. The connector of claim 11, wherein upon mating engagement of said upper housing section and said base section a dielectric barrier is additionally formed on an outside bottom surface of said base section between respective portions of said wire wrap tails.

13. A connector comprising:

a lower portion with a front side, a rear side and a bottom;

a pair of terminals being disposed in said lower portion in spaced apart relation to form a gap there between, each terminal of said pair of terminals having a lower extremity;

a base dimensioned and shaped for receiving said lower portion, said base having a pair of terminal openings for receiving said lower extremities;

a first wall portion disposed between said pair of terminal openings; and a second wall portion disposed on said bottom of said lower portion adjacent said gap and facing said base, said second wall portion partially bounding at least one of said terminals, said first wall and said second wall being dimensioned and shaped so as to meet when said lower portion is placed in said base to form a dielectric barrier in said gap.

14. A connector according to claim 13, further comprising a groove disposed on a bottom outer surface of said base between said terminal openings.

* * * * *